US008798294B2

(12) United States Patent
Havenith et al.

(10) Patent No.: US 8,798,294 B2
(45) Date of Patent: Aug. 5, 2014

(54) HEARING AID, EXPANSION UNIT AND METHOD FOR MANUFACTURING A HEARING AID

(75) Inventors: Michel Martin Marie Havenith, Zoetermeer (NL); Aeldrik Pander, The Hague (NL); Marcus Johannes Aloysius Kaal, Amsterdam (NL)

(73) Assignee: ExSilent Research B.V., Amsterdam (NL)

( * ) Notice: Subject to any disclaimer, the term of this patent is extended or adjusted under 35 U.S.C. 154(b) by 800 days.

(21) Appl. No.: 12/374,490

(22) PCT Filed: Jul. 18, 2007

(86) PCT No.: PCT/NL2007/050359
§ 371 (c)(1), (2), (4) Date: May 28, 2009

(87) PCT Pub. No.: WO2008/010716
PCT Pub. Date: Jan. 24, 2008

(65) Prior Publication Data

US 2009/0262964 A1 Oct. 22, 2009

(30) Foreign Application Priority Data

Jul. 21, 2006 (NL) ..... 1032220
Jan. 25, 2007 (NL) ..... 1033281

(51) Int. Cl.
*H04R 25/00* (2006.01)

(52) U.S. Cl.
USPC ..... 381/314; 381/312; 381/315; 381/326; 381/327; 381/328; 381/330

(58) Field of Classification Search
USPC ..... 381/312, 314–315, 326–328, 330
See application file for complete search history.

(56) References Cited

U.S. PATENT DOCUMENTS 4,727,582 A * 2/1988 de Vries et al. ..... 381/330
5,533,130 A * 7/1996 Staton ..... 381/327

(Continued)

FOREIGN PATENT DOCUMENTS

CN 1096611 A 12/1994
CN 1643981 A 7/2005

(Continued)

OTHER PUBLICATIONS

International Search Report dated Dec. 4, 2008, from corresponding PCT application.

(Continued)

*Primary Examiner* — Fernando L. Toledo
*Assistant Examiner* — Mohammed Shamsuzzaman
(74) *Attorney, Agent, or Firm* — Young & Thompson

(57) ABSTRACT

A hearing aid includes a device housing to be worn outside an ear of a user and which co-acts with an in-the-ear part provided with a sound-emitting opening and which is intended and adapted to be received at least substantially in the ear of the user. The in-the-ear part is physically separated from the device housing, wherein at least a microphone and a loudspeaker are accommodated together with the sound-emitting opening in the in-the-ear part. An electronic connection is present between the device housing and the in-the-ear part. A power supply of a hearing aid particularly includes a capacitor (40), more particularly an ultra-capacitor. The functionality of a hearing aid can be expanded with an expansion unit (50). For an accurate fit of the in-the-ear part use is made of a digital representation which has been modified on the basis of fitting data of a fitting body.

29 Claims, 7 Drawing Sheets

(56) References Cited

U.S. PATENT DOCUMENTS

| | | | | |
|---|---|---|---|---|
| 5,712,919 | A | 1/1998 | Ruhling | |
| 5,721,783 | A * | 2/1998 | Anderson | 381/328 |
| 6,205,227 | B1 | 3/2001 | Mahoneu et al. | |
| 6,484,842 | B1 * | 11/2002 | Widmer et al. | 181/129 |
| 6,533,062 | B1 | 3/2003 | Widmer et al. | |
| 6,590,986 | B1 | 7/2003 | Fazio | |
| 6,594,370 | B1 * | 7/2003 | Anderson | 381/315 |
| 6,751,494 | B2 | 6/2004 | Collier et al. | |
| 7,027,608 | B2 * | 4/2006 | Fretz et al. | 381/330 |
| 7,062,223 | B2 | 6/2006 | Gerber et al. | |
| 7,110,562 | B1 | 9/2006 | Feeley et al. | |
| 7,215,789 | B2 * | 5/2007 | Shennib et al. | 381/328 |
| 7,289,639 | B2 | 10/2007 | Abel et al. | |
| 7,606,382 | B2 * | 10/2009 | Feeley et al. | 381/330 |
| 7,804,975 | B2 * | 9/2010 | Meier et al. | 381/322 |
| 7,844,065 | B2 * | 11/2010 | von Dombrowski et al. | 381/328 |
| 2001/0033501 | A1 | 10/2001 | Nebrigic | |
| 2002/0085728 | A1 * | 7/2002 | Shennib et al. | 381/328 |
| 2004/0081328 | A1 * | 4/2004 | Leedom et al. | 381/312 |
| 2004/0165742 | A1 * | 8/2004 | Shennib et al. | 381/326 |
| 2004/0185773 | A1 * | 9/2004 | Gerber et al. | 455/3.06 |
| 2004/0258263 | A1 * | 12/2004 | Saxton et al. | 381/328 |
| 2005/0008175 | A1 * | 1/2005 | Hagen et al. | 381/314 |
| 2005/0058313 | A1 * | 3/2005 | Victorian et al. | 381/315 |
| 2006/0056649 | A1 * | 3/2006 | Schumaier | 381/326 |
| 2006/0098389 | A1 | 5/2006 | Liu et al. | |
| 2006/0159298 | A1 | 7/2006 | von Dombrowski et al. | |
| 2007/0003089 | A1 * | 1/2007 | Harrison et al. | 381/330 |
| 2007/0104344 | A1 * | 5/2007 | Goldberg | 381/324 |
| 2008/0260191 | A1 * | 10/2008 | Victorian et al. | 381/315 |
| 2010/0086157 | A1 * | 4/2010 | Feeley et al. | 381/324 |
| 2010/0202643 | A1 * | 8/2010 | Nielsen | 381/323 |
| 2011/0280423 | A1 * | 11/2011 | Nielsen | 381/317 |
| 2012/0281865 | A1 * | 11/2012 | Caldarola | 381/328 |

FOREIGN PATENT DOCUMENTS

| | | | |
|---|---|---|---|
| DE | 24 06 218 | | 8/1975 |
| DE | 30 06 235 | | 10/1980 |
| DE | 40 41 105 | | 6/1992 |
| EP | 0 158 391 | | 10/1985 |
| EP | 1 272 001 | | 1/2003 |
| EP | 1 460 769 | | 9/2004 |
| EP | 1 596 633 | | 11/2005 |
| JP | S52022403 | A | 2/1977 |
| JP | S60232800 | A | 11/1985 |
| JP | H0555734 | U | 7/1993 |
| JP | H0720800 | U | 4/1995 |
| JP | H11511301 | A | 9/1999 |
| JP | 2002502211 | A | 1/2002 |
| WO | 96/41498 | | 12/1996 |
| WO | 99/55131 | | 11/1999 |
| WO | 01/35695 | | 5/2001 |
| WO | 02/21894 | | 3/2002 |
| WO | 2005029918 | A1 | 3/2005 |

OTHER PUBLICATIONS

Johan Hellgren et al., "System identification of feedback in hearing aids", Journal of the Acoustical Society of America, Jun. 1999, p. 3481-3496.

Mark Ross, "Feedback Cancellation Systems and Open-Ear Hearing Aid Fitting", Dr Ross on Hearing Loss, Jul./Aug. 2006, http://www.hearingresearch.org/ross/hearing_aid_use/feedback_cancellation_systems_and_open-ear_hearing_aid_fitting.php.

Michael Hoen et al., "Hearing aids with external receivers: Can they offer power and cosmetics?", The Hearing Journal, Jan. 2007, vol. 60, No. 1, p. 28-29, and 32-34.

Stephen A. Hallenbeck et al.. "Thin-tube and receiver-in-cancel devices: There is positive feedback on both!", The Hearing Journal, Jan. 2008, vol. 61, No. 1, p. 28, 30.

Chinese Office Action, dated Dec. 7, 2011, from corresponding CN application.

Japanese Office Action, dated Jun. 29, 2012, from corresponding JP application.

* cited by examiner

HEARING AID, EXPANSION UNIT AND METHOD FOR MANUFACTURING A HEARING AID

The present invention relates to a hearing aid, in particular one comprising a device housing which is intended and adapted to be worn outside an ear of a user and which co-acts with an in-the-ear part which is provided with a sound-emitting opening and which is intended and adapted to be received at least substantially in the ear of the user, and which comprises at least an electric power supply, a microphone, a loudspeaker and a processing device for the purpose of reproducing sound received via the microphone in at least partly processed manner via the loudspeaker and generating it from the sound-emitting opening to an auditory organ of the user. The invention also relates to an expansion unit for application with a hearing aid. the invention further relates to a method for manufacturing a hearing aid with an in-the-ear part which is intended and adapted to be received fittingly in an ear of a user, wherein a likeness of the ear is taken at least at the intended location and wherein at least an outer casing of the in-the-ear part is derived from the likeness.

A hearing aid, also referred to as deaf-aid, is a small electronic device with which the hard of hearing and the deaf with residual hearing can discern sound better. For the deaf, a hearing aid likewise serves to support lip-reading. A technical distinction can be made between the various hearing aids.

Analog hearing aids, which are now to some extent obsolete, have been known for a long time. These hearing aids have a device housing usually having therein an electric battery power supply, a microphone, a processing device in the form of an analog amplifier and a loudspeaker for reconverting an electrical output signal from the amplifier into sound. The device housing moreover almost always has an on/off switch, a volume control button, and sometimes a selection button. In these hearing aids the device housing is usually worn behind the ear, wherein the output sound is guided inside the auditory canal with an in-the-ear part in the form of a small tube. The sound leaves the in-the-ear part from a sound-emitting opening provided for this purpose, and thus reaches the natural auditory organ of the user in amplified form. The current hearing aids are for the most part digital hearing aids. Instead of an analog amplifier, as in analog devices, they have a digital sound processing device in the form of an integrated circuit, a so-called chip. This chip converts the analog sound into an electronic digital signal and is herein able to analyse and modify the sound signal. The quiet sounds are for instance amplified relatively more strongly than the loud sounds. Advanced chips are even able to recognize speech and filter out background noise. The hearing aids are then often provided with direction-sensitive microphones and various processing programs for different listening situations. The result hereof is that the user can understand speech better and that the device sounds more natural and more muted.

Hearing aids exist in all types and sizes. Best known is the behind-the-ear (BTE) hearing aid. This is currently the most commonly used hearing aid. The device housing is here an ear hanger which is worn behind the ear and comprises all components of the device. The sound is guided into the ear via a small tube having on a free end a passive in-the-ear part, such as a made-to-measure earpiece or a more or less standard soft-tip. The in-the-ear part at least practically fits into the ear and comprises the sound-emitting opening from which the sound finds its way to the eardrum of the user.

In addition, there is the so-called in-the-ear (ITE) hearing aid. The device housing thereof is made to measure and is worn in the auricle, relatively not far into the ear. The device is hereby less visible than a BTE hearing aid. The device housing comprises all components of the device. This latter is also the case for the so-called completely-in-the-canal device (CIC). This device is smaller and lies deeper in the ear, and even for the most part in the auditory canal. The made-to-measure device housing here also comprises all components of the device. The device is worn so far into the ear that it is even (almost) wholly invisible.

For hearing aids small, circular batteries, so-called button cells or hearing aid batteries, are generally used as power supply. Increasing miniaturization of hearing aids has acoustic and cosmetic advantages, but is greatly limited by the battery which, if it has a smaller physical size, will generally have a correspondingly more limited lifespan. This is a particular problem for CIC devices, which hereby have only a relatively limited period of operation compared to the larger batteries which can be applied in BTE devices. Conventional batteries moreover require a supply of oxygen for their operation. A battery compartment must therefore be provided with an open airway to the outside. In addition, CIC devices are often intentionally embodied with an open connection between the proximal and distal ends of the device, a so-called venting, so as to reduce occlusion. In a CIC device with a distal battery compartment such an open airway can result in an undesired acoustic channel along the hearing aid, resulting in the danger of acoustic feedback. In addition, a CIC device becomes less readily accessible for operation by the user the deeper it lies in the auditory canal. From an acoustic viewpoint CIC devices are however recommended, because sound is thus received at the most natural location and guided to the eardrum in particularly efficient manner, and furthermore the device is cosmetically less noticeable and disruptive.

The present invention has for its object to provide a hearing aid of the type stated in the preamble, which combines these advantages to at least significant extent while not having any of the drawbacks.

SUMMARY OF THE INVENTION

In order to achieve the intended object, a hearing aid of the type stated in the preamble has the feature according to the invention that the in-the-ear part is physically separated from the device housing, that at least the microphone and the loudspeaker are accommodated together with the sound-emitting opening in the in-the-ear part, and that at least during operation an electronic connection is present between the device housing and the in-the-ear part. Use is made here of a hybrid setup, wherein the electronic components of the hearing aid are divided over separate parts. The device housing, which is worn outside the ear, can accommodate the power supply and the processing device in addition to possible operating members and electronic connections. The loudspeaker and microphone are on the other hand accommodated in the in-the-ear part. Acoustic advantages such as a deep microphone and loudspeaker placing are hereby retained, and the physical adjustment range is greater due to the small dimensions. In the absence of further components in the in-the-ear part, which is worn substantially in the ear, it can be relatively small and can be placed relatively deeply in the ear. The overall acoustic quality of the hearing aid hereby surpasses that of a conventional CIC device. In addition, the space taken up by the components accommodated in the in-the-ear part is saved in the device housing, whereby the device housing can be correspondingly more compact and cosmetically less noticeable. All in all, the hearing aid according to the invention thus combines advantages of a BTE device and a CIC device, while the above stated specific drawbacks of these devices are at least significantly avoided.

A particular embodiment of the hearing aid according to the invention has the feature that the in-the-ear part also comprises the processing device, optionally supplemented with communication connections for programming thereof and for data transfer with an external unit. By thus also accommodating the processing device in the in-the-ear part the device housing, which is worn outside the ear, can be proportionately smaller and thus less conspicuous. Furthermore, the electronic connection between the device housing and the in-the-ear part does not therefore have to entail (much) more than a pair of power supply lines for providing the components in the in-the-ear part with a supply voltage and current.

With a view to an electric power supply to electronic components accommodated in the in-the-ear part, a further particular embodiment of the hearing aid according to the invention has the feature that the device housing comprises a primary power supply and that the in-the-ear part is provided with a secondary power supply. The primary power supply can be relatively large here, and herein provides the desired lifespan, while the secondary power supply is continuously recharged in optionally wireless manner during use of the device. The power supply capacity, and thereby the size of the secondary power supply, can thus remain relatively limited. In a further particular embodiment the hearing aid according to the invention has the feature that at least one of the primary and secondary power supply comprises a capacitor, in particular an ultra-capacitor. A capacitor is able to receive and generate charge and hereby function as electric power supply. Because a capacitor has no, or hardly any, "charge memory" like many rechargeable batteries, and an almost unlimited number of recharging cycles, a capacitor is highly suitable as secondary power supply in the above described master-slave relation with a primary power source. A capacitor moreover does not require an oxygen supply, so that a ventilation channel which could possibly provide a parasitic acoustic path, with a danger of acoustic feedback in the device, can be omitted.

In a further particular embodiment the hearing aid according to the invention has the feature that the electronic connection comprises a cord connection. A cord connection is found in practice to be a particularly robust and reliable connection between the two parts of the hearing aid, which in some cases offsets the cosmetic effect thereof which could possibly be perceived as intrusive. The cord connection can here be fixed, i.e. industrially soldered or the like, although in a further preferred embodiment the hearing aid according to the invention has the feature that the cord connection comprises on at least one end a connector for a releasable connection to at least one of the device housing and the in-the-ear part of the device. By making use of a releasable connector connection on both sides of the cord a modular structure is obtained wherein shape, size and colour of both the in-the-ear part, the device housing and the cord can for instance be selected in accordance with the wishes of the user. The hearing aid can thus be assembled in optimal manner, taking into account the anatomy and wishes of the user.

The electronic connection between the device housing and the in-the-ear part of the hearing aid can be wired, but can also take a wholly or partially wireless form. In this respect a further particular embodiment of the hearing aid according to the invention has the feature that the electronic connection comprises a wireless connection for signal transmission. The wireless signal transmission can here comprise switching commands from operating and/or programming members optionally arranged on the device housing, or also or additionally comprise an audio signal which is thus transmitted for instance from a processing device accommodated in the device housing to the loudspeaker, or vice versa from the microphone to the processing device.

Use can also be made of a wireless transmission for an electrical power supply to electric components accommodated in the in-the-ear part, such as in particular a secondary power supply accommodated therein. For this purpose a further preferred embodiment of the hearing aid according to the invention has the feature that the in-the-ear part comprises an inductive coupling element and the device housing comprises an inductive transmitting element, which are able to mutually co-act in order to at least temporarily maintain an electrical supply current from the device housing to the in-the-ear part. A secondary, rechargeable power supply applied here in the in-the-ear part in this case also functions as buffer in the unlikely event of the inductive coupling temporarily being insufficiently available during operation.

A further preferred embodiment of the hearing aid is characterized according to the invention in that the in-the-ear part is accommodated in a separate outer casing which is able and adapted to lie against a wall of an auditory canal of the user while at least practically sealing acoustically all around. The in-the-ear part can thus be a standard, universal component and an individual fit is provided by the outer casing which is adjusted or can be adjusted to the natural anatomy of the auditory canal of the user. A first further particular embodiment of the hearing aid according to the invention has the feature here that the outer casing comprises at least one flexible fin for lying resiliently against the wall of the auditory canal. One or more such flexible fins contribute to the wearer comfort of the device and provides a wide adjustment tolerance.

In a second further particular embodiment the hearing aid according to the invention is characterized in that the outer casing is made to measure for the natural anatomy of the auditory canal and is thus individually modified to the size of the user. Use can be made here of a normal, relatively hard, bio-compatible plastic, which has been cast and processed on the basis of a casting of the ear of the user, although according to the invention the made-to-measure outer casing is advantageously manufactured from a relatively soft, bio-compatible plastic which is able to adjust itself to the natural anatomy of the ear under the influence of the body temperature of the user. Such a soft, made-to-measure outer casing provides enhanced wearer comfort.

Such a size adjustment is usually made on the basis of a likeness in the form of a contact cast which is taken internally in the ear of the user. A paste curing to some extent is arranged for this purpose in the ear, and removed from the ear after having taken on a fixed form. On the basis of this contact cast a (negative) mould is created, in which the desired size adjustment is then moulded. A drawback of such a manufacturing method is that no account is taken here of the capacity of the auditory canal tissue of the user to compress under the influence of a substantially form-retaining body when it is inserted. The final size adjustment may hereby come to lie too loosely in the ear, and seal insufficiently. Furthermore, in the conventional measuring procedure a mould is always applied in which the final made-to-measure part is formed. This requires a significant extra processing step which, in addition to resulting in an extra inaccuracy, has the particular result of increasing production costs.

The present invention further has for its object, among others, to provide a method for manufacturing a hearing aid which obviates one or more of these drawbacks.

For this purpose a method of the type stated in the preamble for manufacturing a hearing aid according to the present invention has the feature that a digital representation of the likeness is created, that an at least substantially fitting body is inserted at the appropriate location in the ear of the user and fitting data thereof are measured, that if necessary the digital representation is modified on the basis of the fitting data of the fitting body and that at least the outer casing of the in-the-ear part is derived faithfully from the possibly modified digital representation of the likeness. The fitting body herein provides the option of determining a local dilation of the auditory canal under the influence thereof. This is discounted in the measured fitting data. By making use of a digital representation of the likeness and if necessary modifying this on the basis of the measured fitting data of the fitting body a local dilation of the inner ear can be digitally incorporated therein in relatively simple manner. This results in a better fit of the final in-the-ear part which is reproduced from the thus optionally modified digital representation of the likeness.

The digital representation can be obtained more or less directly by (digitally) scanning the ear internally. In the case the equipment required for this purpose is not available, a particular embodiment of the method according to the invention has the feature that the likeness comprises a contact cast and that a digital representation of the cast is obtained by means of a three-dimensional scan.

A preferred embodiment of the method according to the invention has the feature that at least the outer casing of the in-the-ear part is formed from a suitable starting material directly from the modified digital representation. A separate processing step with a mould is thus avoided, as is usual in the conventional method. If however the in-the-ear part must be formed from a material which does not allow of direct forming in such a manner, it is possible to resort to a further particular embodiment of the method which is characterized according to the invention in that a mould is formed from a suitable starting material on the basis of the modified digital representation and that at least the outer casing of the in-the-ear part is formed in the mould. A possible local dilation of the ear of the user under the influence of a substantially form-retaining body inserted therein is also taken into account in this case in that use is made of the possibly modified digital representation in the manufacture of the mould. The use of a mould does however fit in with a more conventional manufacturing method, whereby all materials available for this purpose can also be applied within the method according to the invention.

With a view to an improved directional sensitivity and a better spatial sound perception, a further particular embodiment of the hearing aid according to the invention has the feature that the device housing is provided with at least one further microphone. The output signals of the individual microphones are fed to the processing device, which creates an output signal therefrom which approximates as far as possible the desired spatial acoustics and enhances the directional sensitivity. This contributes significantly to a natural, clear perception of sound by the user, which particularly also enhances the clarity of speech.

From a logistical viewpoint use is also made of a standard component for the device housing. In order to nevertheless provide an individual adaptability thereof, a further preferred embodiment according to the invention has the feature that the device housing is provided with an exchangeable outer shell. The colour and design of the exchangeable outer shell or casing can thus for instance be adjusted to the user, while a standard device housing is inserted therein.

The progressive miniaturization of hearing aids results in an increasing need for a compact and reliable power supply which preferably does not require changing and can operate without oxygen. As indicated above, according to an aspect of the invention particularly a capacitor is highly suitable as electrical power supply in this respect. In accordance with this aspect of the invention, a hearing aid comprising at least one electronic component and an electric power supply for power supply to the at least one electronic component has the feature according to the invention that the power supply comprises an ultra-capacitor. Within the scope of the present application an ultra-capacitor is understood to mean a capacitor having in fully charged state an energy density of more than about 1.0 Wh/kg, in particular an energy density between about 1 and 10 Wh/kg.

A further particular embodiment of the hearing aid herein has the feature according to the invention that the ultra-capacitor is formed from a number of elongate dielectric tubes, in particular of carbon, placed at least substantially parallel adjacently of each other and having a diameter in the order of several to several tens of nanometers and a length which is several thousand to several hundreds of thousands times greater than their diameter. Such an ultra-capacitor requires relatively small macroscopic dimensions with a sufficiently large storage capacity and can be accommodated as separate component in the device or be integrated with one of the other electronic components of the hearing aid, in particular with a possible processing device which will usually be manufactured in a mutually compatible manufacturing process.

A potential difference over a capacitor generally depends on the quantity of charge thereon. Because this quantity of charge will gradually decrease during use, the potential difference will also fall. In order to nevertheless provide the electronic component(s) with a fixed supply voltage, a further preferred embodiment of the hearing aid according to the invention has the feature that a DC-DC converter is provided to receive a variable direct voltage from the ultra-capacitor and to generate an at least almost fixed, lower direct voltage, and that the ultra-capacitor is coupled via the DC-DC converter to the at least one electronic component in order to apply thereover an at least almost stable direct voltage.

A further preferred embodiment of the hearing aid is characterized according to the invention in that the ultra-capacitor is coupled to an inductive coupling element in order during operation to intercept and receive an externally applied electromagnetic induction field as charging current therefrom. The ultra-capacitor can thus be charged and recharged in contactless or at least wireless manner without the power supply having to be removed from its housing for this purpose. The power supply can thus for instance be hermetically cast into the material of the device and is hereby highly resistant to a moist or even wet environment, in particular that of the auditory canal.

A further aspect of the invention has for its object to enhance the functional use and/or the convenience of use of a hearing aid for the user. For this purpose a hearing aid comprising a device housing with at least one electronic component has the feature according to the invention that electronic coupling means are provided for coupling to an optionally processor-controlled portable external expansion unit. The external expansion unit can for instance be worn in the clothing or on the body, for instance round the neck, of the user and provides the hearing aid with extra functionality.

A first further particular embodiment of the hearing aid according to the invention has the feature as such that the coupling means comprise means for wireless signal transmission in accordance with a first protocol for wireless communication between the hearing aid and the expansion unit, and that the expansion unit is moreover equipped with means for wireless signal transmission in accordance with a differing second protocol for wireless communication between the expansion unit and a further device. The expansion unit thus forms a wireless transmission gateway between the further device and the hearing aid. The first protocol, with which communication with the hearing aid takes place, does not here have to be standardized, and can be specifically adjusted for use with the hearing aid. The associated electronics can hereby be limited in respect of cost and in respect of size and power consumption. The expansion unit is then capable of a "translation" to the second protocol, which does for instance comply with a general standard and enables communication with devices of different type and origin.

In a further particular embodiment a hearing aid according to the invention has the feature that a rechargeable power supply is applied therein as power supply, that the expansion unit is provided with a further power supply, and that the coupling means comprise a power supply connection for supply to the rechargeable power supply from the power supply of the expansion unit. The expansion unit herein supplies a back-up power supply for the rechargeable power supply of the hearing aid. For the further power supply it is possible to opt for an optionally rechargeable battery or a mains power supply connection which can be coupled to the public mains via a suitable power supply adapter. Because the expansion unit will have fewer limitations in respect of the physical dimensions thereof when compared to the hearing aid itself, the operating duration of the hearing aid can thus be increased considerably in particularly practical manner.

By means of the expansion unit a headset function can, among others, also be added to the hearing aid for the purpose of telephone communication. For this purpose a further particular embodiment of the hearing aid according to the invention has the feature that the expansion unit is provided with at least one further microphone. This at least one further microphone can be applied for receiving speech from the user, wherein the expansion unit is adapted and able to co-act with a personal telephone device of the user so as to generate thereto a speech signal emitted by the at least one microphone of the expansion unit and to transmit a telephone signal received therefrom to the hearing aid. The at least one microphone in the expansion unit thus serves to receive and transmit the speech of the user to the telephone device as an electronic speech signal, while an audio signal received from the telephone is transmitted by the expansion unit to the hearing aid and generated to the user via the loudspeaker thereof. In addition or instead the at least one microphone of the expansion unit can also serve to give the hearing aid an enhanced directional sensitivity. Directional sensitivity can be achieved by embodying the expansion unit with for instance two or more microphones which act as a series of microphones. It is in principle the case here that the greater the number of microphones applied, the greater the directional sensitivity obtained. By placing the expansion unit on for instance a table during a conversation, it can thus be used as a separate direction-sensitive receiver, an output signal of which is transmitted to the processing device of the hearing aid.

The expansion unit can also serve as gateway for other audio sources. A further particular embodiment of the hearing aid has for this purpose the feature according to the invention that the expansion unit is provided with coupling means for signal transmission from an external audio source in order to receive an audio signal therefrom, and that the expansion unit is adapted and able to transmit the audio signal to the hearing aid. In addition, the expansion unit itself can serve as personal audio source of the user. A further particular embodiment of the hearing aid has for this purpose the feature according to the invention that the expansion unit is provided with storage means for electronic data storage, in particular an electronically rewritable and readable semiconductor memory such as Flash EEPROM (Electronically Erasable and Programmable Read Only Memory). Audio files, among others, can thus be stored in the expansion unit. By feeding a suitable, per se known program code to the processor of the expansion unit, an audio signal can be obtained from the code which is generated to the hearing aid. For the purpose of such, and other, data storage in the expansion unit, a further particular embodiment of the hearing aid according to the invention has the feature that the expansion unit comprises a standardized communication interface for data exchange with an optionally portable computer, in particular one comprising a standard interface for data exchange such as a USB (Universal Serial Bus) port or a FireWire connection. The expansion unit can thus be coupled to an ordinary computer in a manner which is standard for data exchange.

Modern digital hearing aids possess a digital processing unit which is able to analyse a received audio signal and selectively amplify or optionally damp it on the basis of specific audio frequencies and/or other parameters. The processing device can moreover be controlled for different situations on the basis of mutually differing processing profiles in order to filter out a useful signal to a greater or lesser extent and thus cause it to sound as clear as possible. In order to enable a user to select a desired actuating profile or to (re) program the processing device in a specific situation, a further particular embodiment of the hearing aid according to the invention has the feature that the expansion unit is provided with a programming interface which is able and adapted to exchange data with a corresponding programming interface of the hearing aid for the purpose of adjusting the processing device. The hearing aid can thus be programmed by the user from the expansion unit. This moreover has the advantage that the in-the-ear part of the hearing aid can be supplied as a more or less standard product and can then be adjusted as desired by the user, so that an exclusive network of audiologists or other specialists for sale and distribution is no longer required, or at least need be relied on less.

In order to carry the expansion unit invisibly under clothing, a further particular embodiment of the hearing aid according to the invention has the feature that the expansion unit is connected to a necklace.

The present invention also relates to an expansion unit for application with a hearing aid as described above, and will now be further elucidated on the basis of an exemplary embodiment and an accompanying drawing.

BRIEF DESCRIPTION OF THE DRAWINGS

The figures are otherwise purely schematic and not drawn to scale. Some dimensions in particular may be exaggerated to greater or lesser extent for the sake of clarity. Corresponding parts are designated as far as possible in the figures with the same reference numeral.

DETAILED DESCRIPTION OF THE PREFERRED EMBODIMENTS

Figure 1:
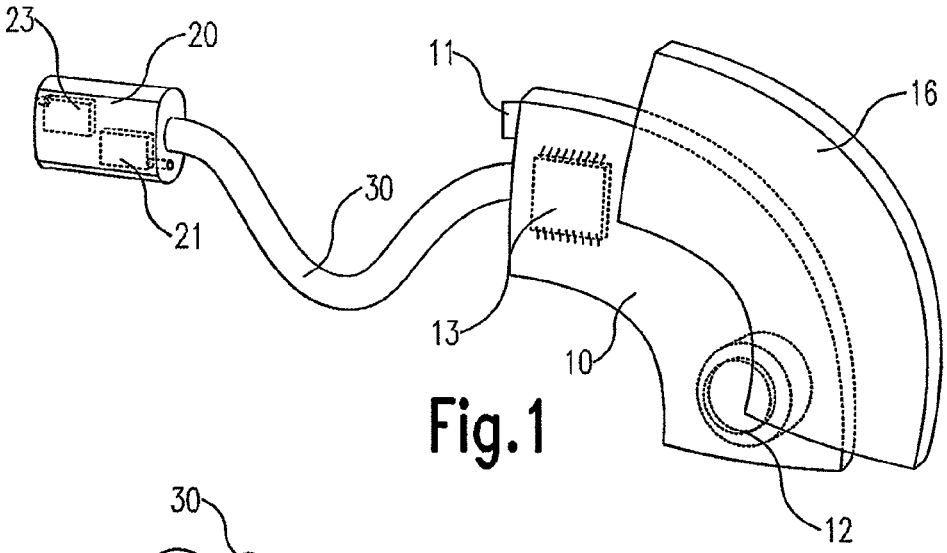
FIG. 1 shows a perspective view of a first exemplary embodiment of a hearing aid according to the invention.
Figure 2:
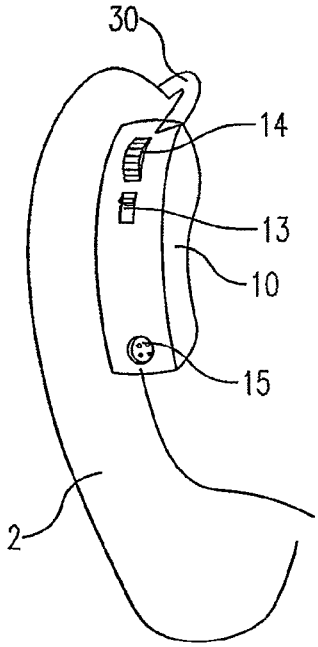
FIG. 2 shows a rear view of the hearing aid of FIG. 1 in use.
Figure 3:
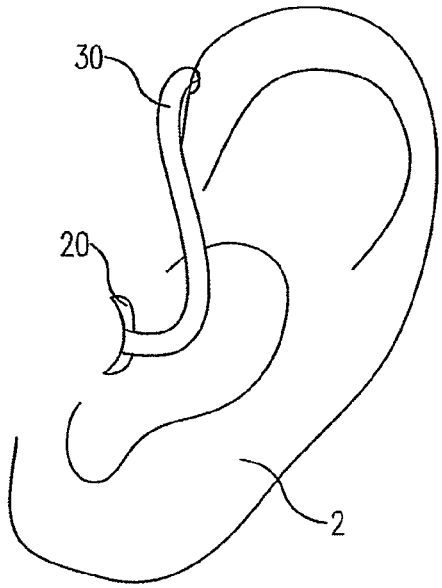
FIG. 3 shows a side view of the hearing aid of FIG. 1 in use.

FIG. 1 shows schematically an exemplary embodiment of a hearing aid 1 according to the invention. Hearing aid 1 comprises a device housing 10 which is worn behind the ear 2, see also FIG. 2, and an in-the-ear part 20 which is received in the auditory canal 2 of the user, see also FIG. 3. In-the-ear part 20 comprises on a proximal side a microphone 21 for receiving ambient sound and on a distal side a sound-emitting opening 22, see FIGS. 4 and 5, for generating sound developed by a loudspeaker 23 to an eardrum of the user. Loudspeaker 23 is here also accommodated in the in-the-ear part 20. Preferably situated between sound-emitting opening 22 and loudspeaker 23 is a cerumen protection (not further shown) for intercepting and optionally buffering cerumen possibly secreted in the auditory canal, so that it does not adversely affect the operation of the loudspeaker. This is for instance a locally widened portion, a curve or obstacle in an auditory canal, between loudspeaker 23 and sound-emitting opening 22, which at least temporarily blocks or intercepts cerumen.

Device housing 10 provides space for an electronic power supply 12 and a digital processing device 13 which is able to process a sound signal emitted by microphone 21 and here amplify it in optionally selective manner in order to generate the thus processed and possibly amplified signal to loudspeaker 23. A common, optionally rechargeable button cell or other battery can be used as power supply 12, or use can be made of a rechargeable capacitor, in particular an ultra-capacitor which will be further described hereinbelow. In the case of a rechargeable power source use is advantageously made of an easily handled battery pack which can be removed separately for external recharging and can optionally be directly replaced by an already fully charged one. The device hereby always remains ready for use.

One or more further microphones 11 can optionally be provided in device housing 10, which generate additional input signals to the processing device so as to obtain an improved spatial sound image and an enhanced directional sensitivity, and to generate the ambient sound to the user in a more natural manner. Device housing 10 can additionally be equipped with operating members such as an on/off switch 13 and a volume button 14, so that the user can switch the device on or off and adjust it as desired. For further-reaching changes in the settings of the device, particularly the setting of a processing profile or characteristic of the processing device, the device housing moreover comprises a programming connector 15 which can be coupled to specific programming equipment of for instance a maintenance engineer or an audiologist.

The in-the-ear part 20 and device housing 10 are mutually connected by means of an electronic connection in the form of a connecting cord 30. In this example connecting cord 30 comprises a number of pairs of cores, on the one hand for an electrical power supply to the electronic components in the in-the-ear part 20 directly or indirectly from battery 12, and on the other hand for the signal transmission between the components of the device housing and the components in the in-the-ear part. If desired, use can be made here of a releasable cord which is inserted into the relevant part 10,20 of the hearing aid on one or both sides using a suitable connector, and the length and colour of which can for instance thus be adapted to the user.

Device housing 10 is provided with an exchangeable outer casing 16 so that for instance the colour of this part of the hearing aid can also be adapted to the user. Outer casing 16 moreover covers programming connector 15 so that it is less vulnerable to the effects of moisture and contamination from outside. Operating switch 13 and volume button 14, as well as an optional extra microphone 11 in the device housing, are left clear by the outer casing so that they remain directly accessible to the user.

A good fit of in-the-ear part 20 in the ear of the user makes or breaks the sound quality of the hearing aid. A contact surface between in-the-ear part 20 and the auditory canal is therefore preferably adapted precisely to the natural anatomy of the auditory canal. In order to nevertheless enable the use of a more or less standard component for the in-the-ear part, which is desirable from a logistical and manufacturing viewpoint, in-the-ear part 20 is accommodated in a separate outer casing 25 which, when placed, is able and adapted to lie against a wall of the auditory canal while at least practically sealing acoustically all around.

Figure 4:
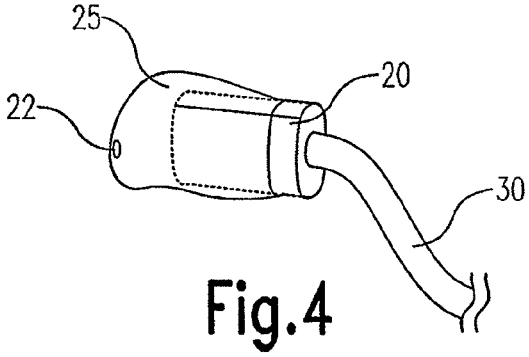
FIG. 4 shows a first embodiment of an in-the-ear part with a releasable outer casing for the hearing aid of FIG. 1.
Figure 5:
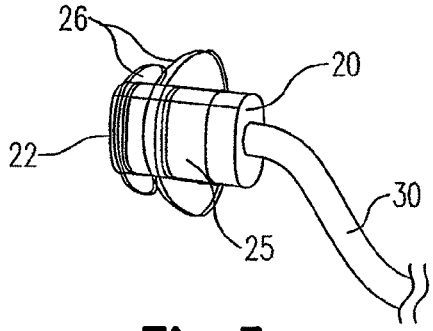
FIG. 5 shows a second embodiment of an in-the-ear part with a releasable outer casing for the hearing aid of FIG. 1.

For outer casing 25 use can be made here of a form-retaining and often relatively hard measured piece, for instance of a plastic curing under the influence of visible or invisible light, this being made to measure by an audiologist as in the embodiment of FIG. 4. On a distal side the outer casing is provided with sound-emitting opening 22. In order to enable easy removal of the in-the-ear part from the ear if desired, a pull cord 24 can be provided thereon, see also FIG. 10G.

Instead of such a relatively hard conventional material, a relatively soft and slightly deformable plastic can also be applied for a made-to-measure outer casing 25. Outer casing 25 is here also precisely made to measure for the natural anatomy of the user. In respect of the plastic which can be applied for this purpose, use can for instance be made of polyurethane or a thermoplastic rubber such as silicone rubber or other synthetic rubber. Use is advantageously made here of a biocompatible plastic which softens under the influence of body temperature and is then able to adjust itself to the natural anatomy of the auditory canal. A gel-like plastic can particularly be chosen here. In such a soft size adjustment a pull cord can be provided, particularly in the form of a monolithic extension of the outer casing which is formed integrally thereon.

An exemplary embodiment of a method according to the invention for manufacturing a hearing aid with such a made-to-measure outer casing is shown in successive stages in FIGS. 10A-10G. A likeness of the ear is herein taken, see FIG. 10A, at least at the position where in-the-ear part 20 will be worn. This may involve a direct internal digital scan of the ear or, as here, a contact cast 91 which is realized in a manner which is relatively conventional and therefore deemed adequately known to the person with ordinary skill in the art. Once this contact cast has hardened sufficiently to obtain the desired form-retention, it is taken out of the ear, see FIG. 10B.

When a relatively rigid in-the-ear part 20 of a hearing aid is used, the auditory canal is dilated and deformed to some extent. Only when the auditory canal is large and relatively wise will the ear cast 91 correspond precisely to the actual shape of the auditory canal after such a body has been inserted. For a reliable size adjustment this dilation and deformation must therefore be included and incorporated into the model. For this purpose a substantially form-retaining fitting body 92 is inserted into the ear, see FIG. 10C, and fitting data thereof are collected. The fitting body is for instance an empty or solid module, as is in-the-ear part 20, but is provided with specific markings 93 and a manipulating handle 94. By positioning the fitting body in the ear in different ways, see FIG. 10D, and recording markings 93, position data of fitting body 92 in the ear are measured. These data provide information relating to the actual dilation and deformation of the ear in the relevant zone 95, see FIG. 10E, while in-the-ear part 20 is being worn, and thus give an impression of the actual fit of such a body in this part 95 of the ear. These data can otherwise be collected before as well as after contact cast 91 is taken.

Figure 10A:
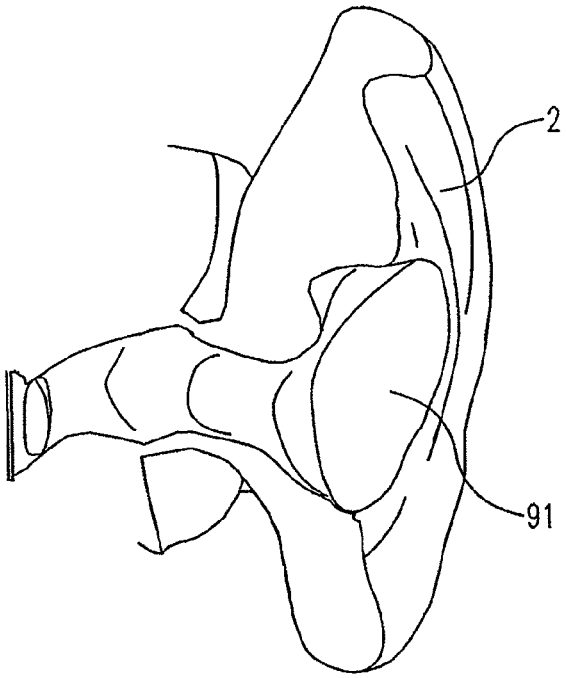
FIG. 10A-G show successive stages of manufacture of an in-the-ear part according to an embodiment of a method according to the invention.
Figure 10B:
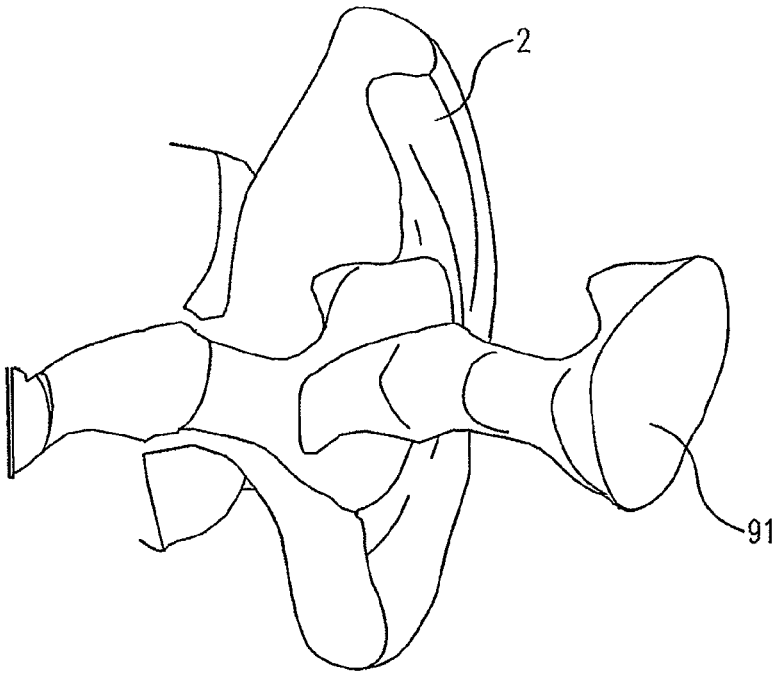
Figure 10C:
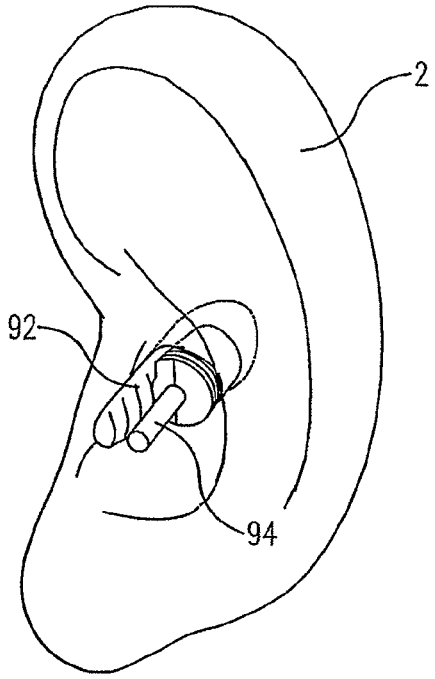
Figure 10D:
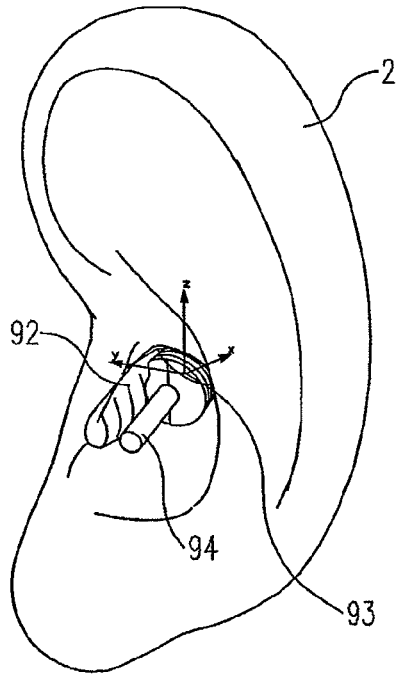
Figure 10E:
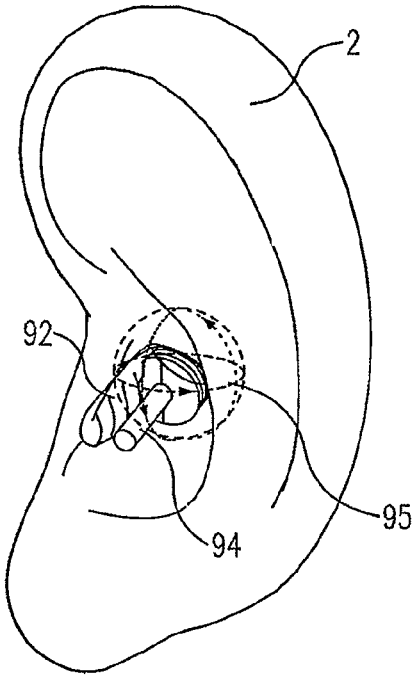
Figure 10F:
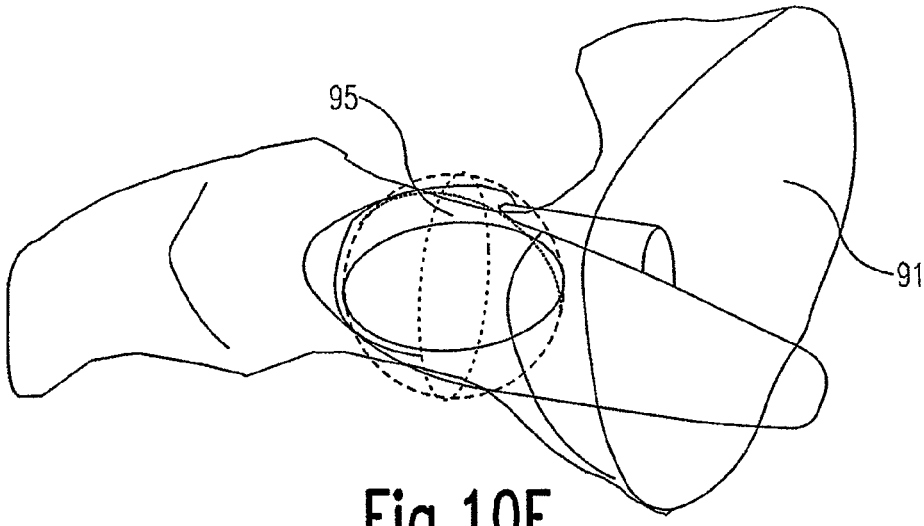

In a subsequent step of the method the ear cast 91 in the relevant area 95 is scanned using a 3D scanner, see FIG. 10F, so that an accurate digital representation thereof is obtained which is inputted into 3D modelling software. This 3D software is used to digitally "trim" the digital representation of the rough cast in the software and to create a sound-emitting opening. The collected fitting data of fitting body 92 are used here to correct the digital representation of ear cast 91.

The made-to-measure part and the rest of outer casing 25 of in-the-ear part 20, such as among other parts a pull cord 24 to enable easy later removal of the in-the-ear part from the ear, are then made of the same material in one processing run. This can be done in different ways. Firstly, the definitive made-to-measure product can be made directly from the possibly modified digital representation of the auditory canal by means of rapid prototyping. In addition to pull cord 24, sound-emitting opening 22 is here also provided in the made-to-measure part 25.

Figure 10G:
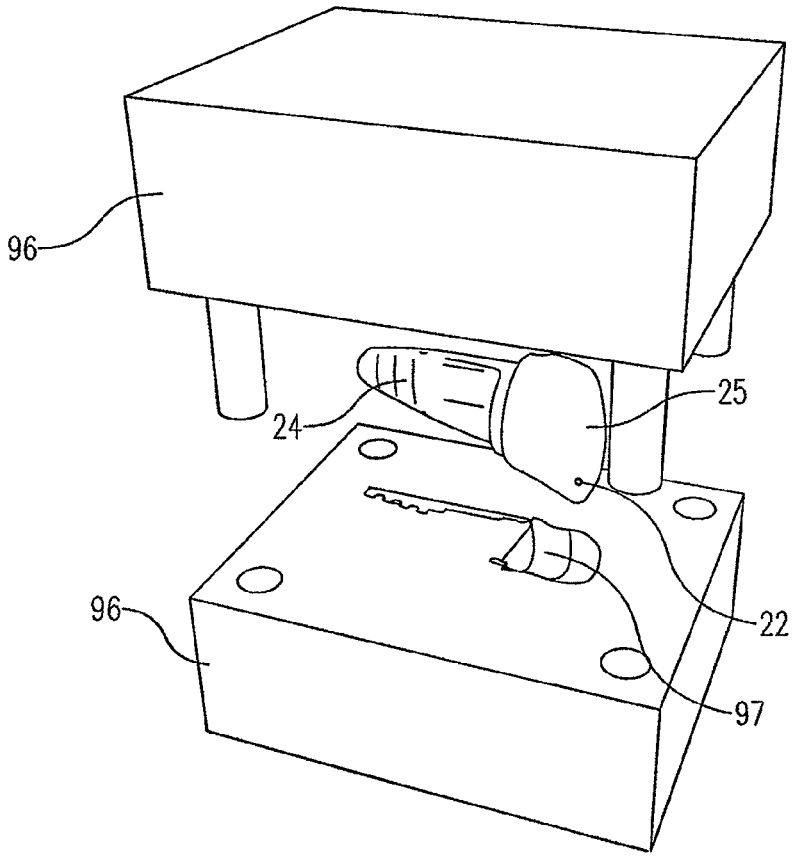

A mould 96 can instead be made from the possibly modified digital representation of the auditory canal by means of rapid prototyping, see FIG. 10G. This mould comprises a negative form 97 of the desired product and is used in a subsequent step to pour a flexible plastic material therein that is used for the final made-to-measure product 25. A suitable material is then poured into the mould so as thus to form the final product 25.

Although the first method is recommended from a production engineering viewpoint since an intermediate step with a mould is unnecessary, it is still not yet possible in practice to use all plastics in this manner because some are as yet not suitable for rapid prototyping. The second process is however very similar to a conventional method of manufacturing hearing aids, so that all the usual plastics and materials can be applied therein.

Instead of a precisely made-to-measure part, it is also possible in respect of outer casing 25 to resort to a standard, relatively soft and deformable hollow body which is able, within relatively wide limits, to adjust itself to the auditory canal. An example hereof is the embodiment of FIG. 5. A so-called soft-tip of relatively soft and deformable material, for instance of the same type as the above specified relatively soft size adjustment, is provided here with flexible fins 26 which connect resiliently to the auditory canal wall and which thus allow a considerable adjustment to the natural anatomy of the user. It is possible here to suffice with a limited number of standard sizes from which a selection can be made subject to the size of the auditory canal of the user. A pull cord can herein also be formed integrally on the outer casing, for instance in the form of a monolithic extension. The soft-tip comprises the sound-emitting opening 22 in its distal side.

The invention thus provides a modular hearing aid which, although constructed from standard components, can nevertheless be adapted in great measure to the user. The hearing aid is herein divided into two parts, i.e. an in-the-ear part and the device housing which is worn behind the ear, and with this hybrid design provides both acoustic, electronic and cosmetic advantages.

Figure 6:
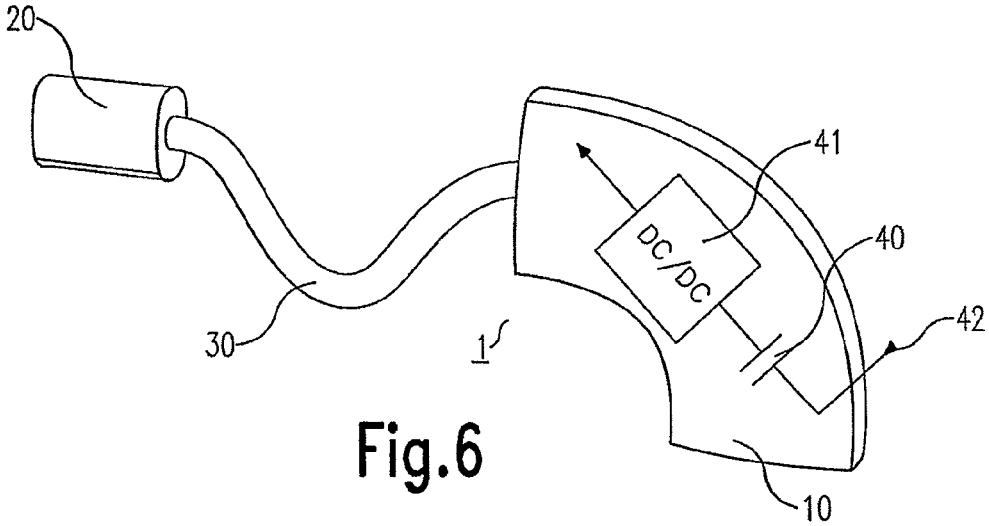
FIG. 6 shows a perspective view of a second exemplary embodiment of a hearing aid according to the invention.

A second exemplary embodiment of the hearing aid according to the invention is shown in FIG. 6, which shows only the functional parts 10,20,30. This embodiment is largely identical to that of the previous example and therefore has the same advantages, be it that use is made in this example of an ultra-capacitor 40 in combination with a DC-DC converter 41 in respect of the electronic power supply. In this respect an ultra-capacitor is understood to mean a capacitor with a minimum energy-weight ratio of about 1.0 Wh/kg. For the present generation of ultra-capacitors this value lies in practice between about 1 and 10 Wh/kg.

Such an ultra-capacitor is manufactured by means of semiconductor technology or micro-machining, and comprises a large number of minute dielectric pillars which extend mutually parallel from a substrate and have a length many thousands of times greater than their diameter, which is no more than several tens of nanometers or a maximum of several hundreds of nanometers. A considerable storage capacity for electrical charge, which can serve as power supply for the hearing aid, can thus be provided on a relatively small surface. In this example an ultra-capacitor with columns of carbon is applied with a net mass of about 5 grams and a storage capacity of about 23 MW-h, at an energy-weight ratio of 4.65.

Figure 7:
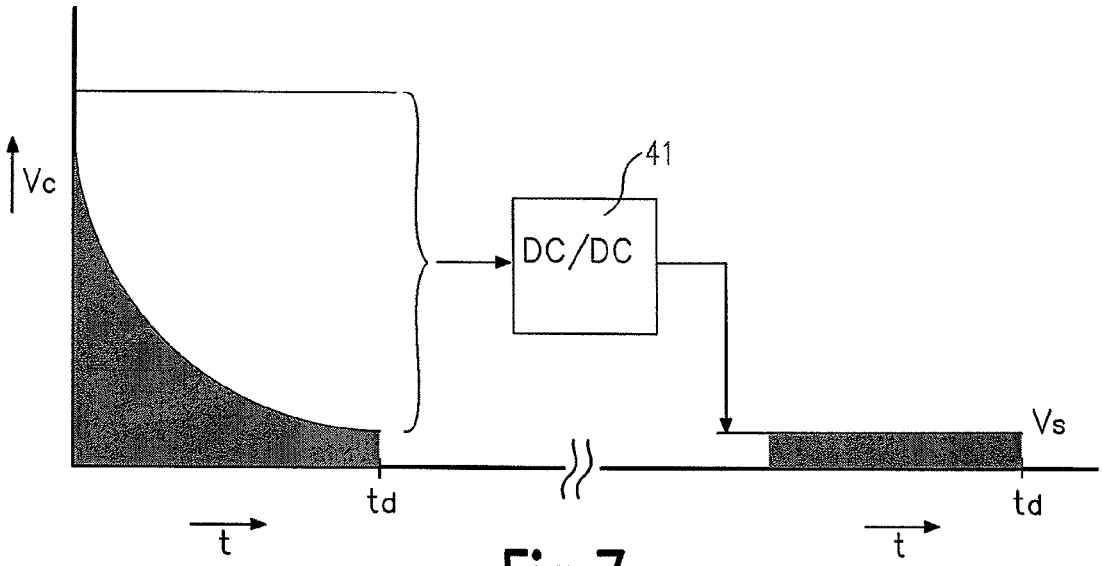
FIG. 7 shows an electronic diagram of the hearing aid of FIG. 6.

The voltage over the ultra-capacitor will decrease with the (operating) time (t) of the hearing aid as more charge is taken off. In order to nevertheless enable a fixed supply voltage to be generated to the electronic components in the device for a maximum operating time ($t_d$), the ultra-capacitor is coupled to the electronics of the hearing aid via the DC-DC converter. Such a converter 41 is able to receive the direct voltage of the ultra-capacitor, which decreases over time, and to always generate an at least practically fixed, lower direct voltage. This operation is shown schematically in FIG. 7. The output voltage Vc, which is variable through time (t), is indicated on the left-hand side in the figure and is converted to a lower but stable supply voltage Vs by means of converter 41. With use of the present generation of hearing aids an acceptable operating time can thus be achieved with an ultra-capacitor as power supply.

The capacitor can then be charged or recharged in well nigh unlimited and relatively rapid manner by means of a charge connection 42 provided for this purpose and a charging device (not further shown) adapted thereto. Use can be made here of a wired connection of the charging device, in which case a charge connector will be provided for this purpose in the device housing, or use can be made of a wireless, inductive charge transfer by means of an inductive coupling element which is arranged in the device housing and which is able to take charge from an electromagnetic induction field generated by the charging device. Apart from practical advantages, this latter also provides mechanical advantages as the power supply of the hearing aid can thus be fully cast and is thus hermetically sealed from the effects of moisture and contamination which could otherwise adversely affect the operating duration of the power supply. In addition, such a design provides advantages from a safety viewpoint.

Figure 8:
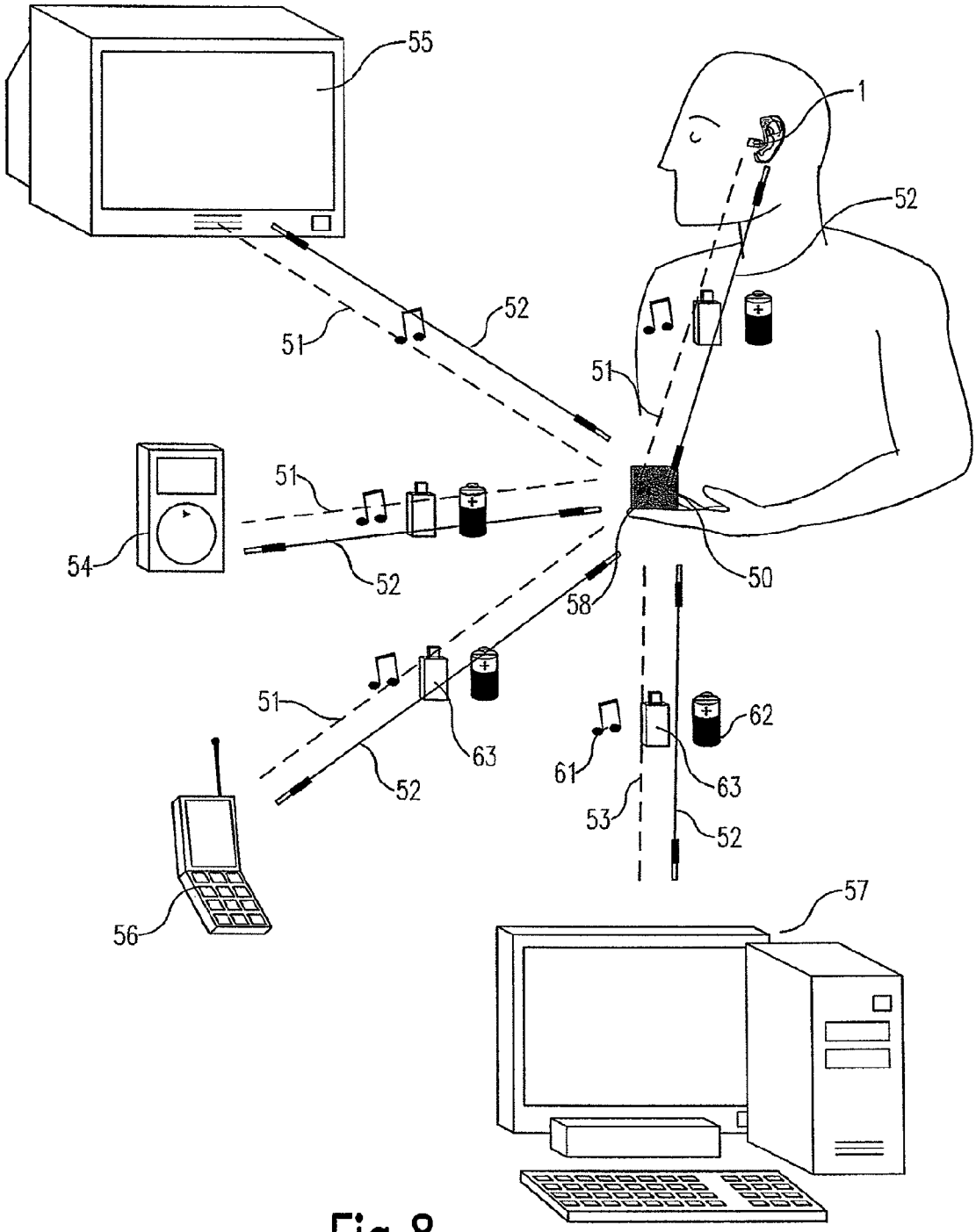
FIG. 8 shows a first embodiment of an expansion unit according to the invention for use with a hearing aid.

The functionality of a hearing aid 2 can be significantly expanded by coupling thereto an, in this example processor-controlled, electronic expansion unit 50 as shown schematically in FIG. 8. The mutual coupling can herein be wireless, which is expressed in the figure by a broken line 51, or wired, indicated with a full line 52, in the form of a direct cable or cord connection. Expansion unit 50 can for instance be worn invisibly under clothing, for instance at stomach height, on a necklace (not further shown).

In its most rudimentary form, the expansion unit comprises only a back-up power supply from which a rechargeable power supply of hearing aid 1 can be charged. For this purpose use is made in the example of FIG. 8 of a (temporary) direct connection 51, such as a cable connection or via charge contacts on which the device can be placed, to feed power to the rechargeable battery or capacitor of hearing aid 1 from an optionally rechargeable back-up power supply of considerably greater capacity of expansion unit 50. In respect of the back-up power supply use can for instance be made of one or more optionally rechargeable AAA batteries, or a mains power supply can moreover be chosen. In the latter case the expansion unit has the connections required for the purpose and a suitable external voltage adapter. When one or more rechargeable batteries or accumulators are applied in the expansion unit, use is advantageously made of a battery pack which can be integrally taken out or taken off to be replaced with a fresh, fully charged pack. The empty battery pack can then be charged in an external charging station, either contactlessly by means of induction or charge contacts provided for this purpose on both parts, and is then ready for subsequent use.

In addition, the expansion unit serves as gateway between the hearing aid and further electronic devices of varying nature. The expansion unit can thus be coupled to an external audio source such as an audio player 54, television 55, telephone 56 or computer 57 so as to receive directly therefrom, optionally wirelessly, in electronic form an audio signal designated in the figure with a music symbol ♫ 61, and to transmit this for instance wirelessly to hearing aid 1. The data transfer can here always take place via a cable connection 52 or wirelessly 51 in accordance with the level of execution, or in both ways.

A power supply line, indicated in the figure with a battery symbol 62, can moreover be constructed here between such peripheral equipment 54 . . . 57 and expansion unit 50 in order to enable charging from the one unit of rechargeable batteries in the other. In addition, expansion unit 50 adds a headset function to (mobile) telephone 56 of the user. For this purpose the expansion unit is provided with a microphone 58 for receiving and transmitting speech of the user to telephone 56, or the expansion unit provides a transmission to telephone 56 of the sound received by microphone 11,21 of the hearing aid. Such an extra microphone of expansion unit 50 can in addition be utilized as extra receiver for hearing aid 1 in order to enhance the quality of the audio signal. A high degree of directional sensitivity can moreover be added by applying a number of such microphones as a series in the expansion unit.

In order to provide a wireless signal transmission, particularly for the exchange of audio signals and data, use is made for reasons of compatibility of a standardized protocol, such as a standard infrared protocol, USB, WiFi, BlueTooth and the like, between expansion unit 50 and possible further equipment 54 . . . 57. The expansion unit possesses the correct interface for this purpose. Between expansion unit 50 and hearing aid 1 use is on the other hand made of an appropriate individual protocol, whereby the required electronics are less susceptible to disruption and less voluminous and have a lower power consumption, which respectively enhance the compactness and lifespan of the hearing aid. The interface required for this purpose is also provided in the expansion unit.

The expansion unit is further equipped with its own electronic memory, typically in the order of several hundred Mb to several tens of Gb, with a view to a personal data storage for the user. In addition to data files which can be read by the user, these data can also comprise music or multimedia files which can then be listened to via the hearing aid. Use is made here, for storing the data, of usual semiconductor memory, such as (flash) EEPROM, which has a relatively low power consumption. For a rapid exchange of these and other data the expansion unit 50 also has a standardized communication interface for data exchange in the form of a USB (Universal Serial Bus) or similar port, this being indicated in FIG. 8 with a corresponding symbol 63. The same interface can be utilized for (re)charging a power supply in the expansion unit and in other peripheral equipment optionally coupled thereto.

The processing device of the hearing aid can be programmed and controlled as desired from the expansion unit in that the expansion unit has a programming interface which is necessary for this purpose and which can be coupled to a programming connector or interface of the hearing aid. The program data required for this purpose can be downloaded into the expansion unit as firmware file, for instance from computer 57 and/or the internet, and making use of the programming interface can in turn be uploaded into the hearing aid by the expansion unit. The user is therefore not dependent on third parties for this.

Figure 9:
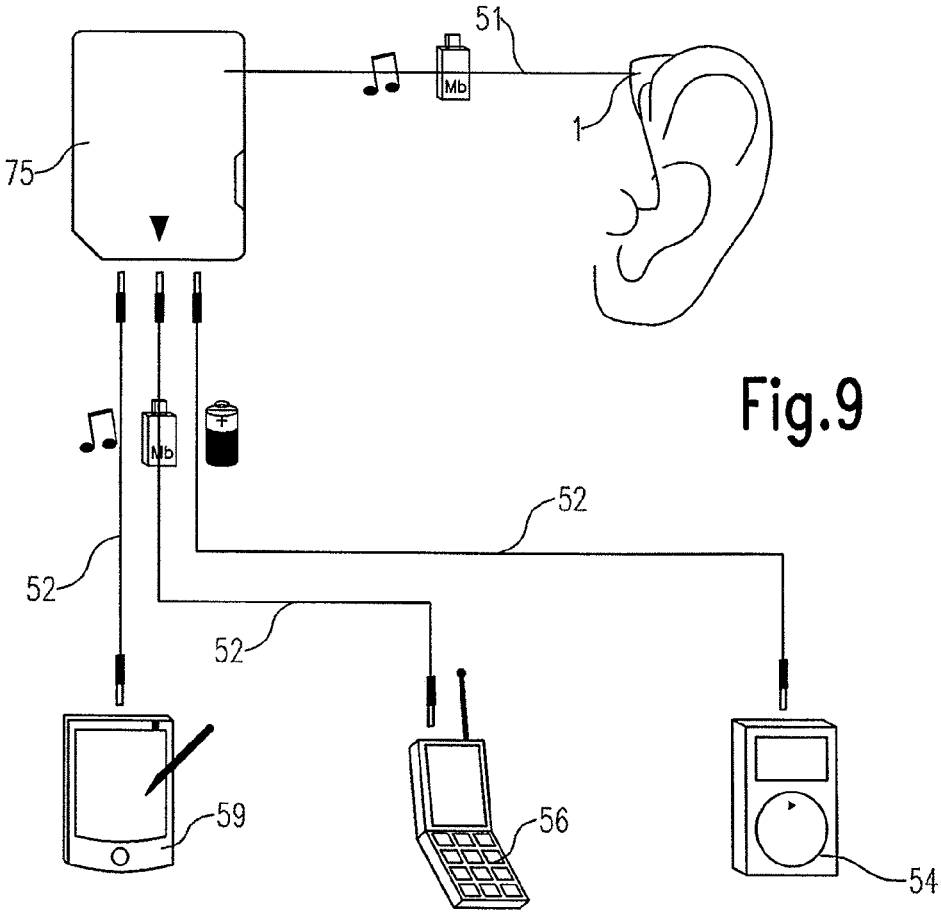
FIG. 9 shows a second embodiment of an expansion unit according to the invention for use with a hearing aid.

A second exemplary embodiment of an expansion unit for use with a hearing aid is shown in FIG. 9. Here the expansion unit is able and adapted to co-act with an otherwise standalone electronic host device. The expansion unit can be inserted for this purpose into the host device, coupled thereto in wired or wireless manner or, as in this example, be almost wholly accommodated in a standardized add-on body 75 for the host device. Add-on body 75 can take physically different forms, varying from a card or a module to diverse forms of sticks and plugs, in accordance with the specific standard which must be met. Add-on body 75 is inserted in the usual manner into an input slot provided for the purpose in the host device, such as a PDA (Personal Digital Assistant) 59 or similar handheld computer, a mobile telephone 56, a multimedia player 54 or a (laptop) computer, and forms from that moment an electronic as well as physical part of the host device.

In respect of body 75 use is made here of a so-called Secure Digital I/O (SDIO) card, although it is also possible to resort instead to numerous other card formats as are available in standardized form. It is for instance also possible here to envisage a Smart Card, as is usually applied in mobile telephones, an MM (Multi Media) card, a PCMCIA (Personal Computer Memory Card International Association) card, an Express card, a CardBus card or similar card, in accordance with the specific add-on application.

Such an add-on body generally has electrical contact surfaces whereby a physical electronic connection 52 to the host device is effected. A mutual electronic co-action is thus possible between the expansion unit arranged on the card and the electronic device into which the card is inserted. The expansion unit is thus for instance powered from the host device, data and signal exchange is thereby possible, and expansion unit 75 can make use of peripheral components of the host device, such as for instance a loudspeaker or microphone. Despite the modest size thereof, the expansion unit of this example can have at least practically the same functions and options as expansion unit 50 of FIG. 8. Card 75 herein comprises all necessary components itself, particularly to the extent these are not already available in electronic host device 54,56,59.

A transmitter/receiver combination for a specific wireless protocol for data transfer with a hearing aid can for instance particularly be arranged on add-on card 75. It is hereby possible to make a wireless connection with the hearing aid directly from a supporting apparatus (PDA, telephone and the like). In this manner it is possible to transmit audio and data (settings) directly to the hearing aid from the connected device. The PDA or telephone can in this way also function as control element or remote control. It would also be possible to use the hearing aid directly as headset for telephone conversations without additional equipment. The add-on card could also be equipped with a memory and/or extra processing capacity (Digital Signal Processor).

Although the invention has been further elucidated above with reference to a number of exemplary embodiments, it will be apparent that the invention is by no means limited thereto. On the contrary, many variations and embodiments are still possible for the person with ordinary skill in the art within the scope of the invention.

Use is for instance made in the described embodiment of a small secondary power supply in the in-the-ear part of the hearing aid, although in practice this can also be omitted, wherein the power supply takes place entirely from the device housing through a power supply connection provided for this purpose between the two parts of the device. For the power supply use is made in the example of a rechargeable battery. It is possible instead to also resort to a 'normal' single-use (button cell) battery, or use can be made of exchangeable battery packs which can be taken out or taken off in simple manner so as to be replaced with a full one and charged externally.

Instead of being accommodated in the device housing, the processing device can conversely also be accommodated in the in-the-ear part together with the loudspeaker and the microphone, so that signal lines between the two parts of the device can be omitted.

In the example, operating members and connections of the device housing are covered by the casing fitting thereover. The casing can instead leave openings clear at the position of the operating members and connections so that they are always directly accessible. Such a releasable casing can also be wholly dispensed with, wherein the wall of the device housing also forms the outer casing. Owing to the applied digital technique, diverse and multiple functions can moreover be assigned to the control buttons.

Instead of being worn behind the ear, the device housing can also be adapted for wearing on, under or even in front of the ear, comparable to an earring, wherein the appearance can be aesthetically modified hereto. If desired, the device housing, optionally designed as an ornamental article, can also be worn around the neck, which imposes fewer limitations on the weight and size thereof.

In the shown example the expansion unit possesses its own microphone. A coupling can instead also be provided between the expansion unit and a microphone of the hearing aid, wherein a separate microphone can then be omitted from the expansion unit without losing functionality. In the case of further miniaturization of the applied electronics, it is also possible to envisage the expansion unit being integrated fully or almost fully into the device housing, wherein a multifunctional hearing aid is then obtained. In the shown example the expansion unit provides a large number of extra functions. It is however possible to equip an expansion unit with only some of these functions, and it is also possible to add further functions thereto. An expansion unit can thus be embodied in different variants.

The invention claimed is:

1. A hearing aid, comprising:

a behind-the-ear (BTE) component, comprising a device housing configured to be worn behind an ear of a user;

a completely-in-canal (CIC) component, comprising a sound-emitting opening, said completely-in-canal (CIC) component being configured to be received completely recessed in the ear canal of the user; and at least an electric power supply, a microphone, a loudspeaker and a processing device for a purpose of reproducing sound received via the microphone and delivering reproduced sound via the loudspeaker and the sound-emitting opening to an auditory organ of the user, wherein the completely-in-canal (CIC) component is physically separated from the behind-the-ear (BTE) component, wherein said completely-in-canal (CIC) component and said behind-the-ear (BTE) component are mutually connected via an electrical cable connection which, at least during operation, establishes an electronic connection between the behind-the-ear (BTE) component and the completely-in-canal (CIC) component, wherein the loudspeaker as well as the microphone are accommodated in the completely-in-canal (CIC) component, wherein said electrical cable connection has a length sufficient for the completely-in-canal (CIC) component and the microphone to reside completely recessed in the ear canal of the user, wherein said processing device is a programmable digital sound processor which reproduces said sound in at least partly processed manner, and wherein the completely-in-canal (CIC) component is accommodated in a casing which comprises at least one flexible fin at an outer circumference thereof for lying resiliently against an inner wall of the ear canal, and wherein the completely-in-canal (CIC) component is removable from the ear by the electrical cable connection and/or a pull cord in the form of a monolithic extension of the casing which is formed integrally therewith.

2. The hearing aid as claimed in claim 1, wherein the completely-in-canal (CIC) component comprises the processing device together with the loudspeaker and the microphone.

3. The hearing aid as claimed in claim 1, wherein the completely-in-canal (CIC) component is removably fitted in said casing.

4. The hearing aid as claimed in claim 1, wherein the device housing comprises a primary power supply, and wherein the completely-in-canal (CIC) component comprises a secondary power supply.

5. The hearing aid as claimed in claim 4, wherein at least one of the primary and secondary power supply comprises an ultra-capacitor having in a fully charged state an energy-weight ratio of more than about 1.0 Wh/kg.

6. The hearing aid as claimed in claim 5, wherein the ultra-capacitor is formed from a plurality of elongate dielectric tubes placed at least substantially parallel adjacently of each other and having a diameter in the order of several to several tens of nanometers and a length which is several thousand to several hundreds of thousands times greater than said diameter.

7. The hearing aid as claimed in claim 5, further comprising:

a DC-DC converter configured to receive a variable direct voltage from the ultra-capacitor and to generate an at least almost fixed, lower direct voltage, wherein the ultra-capacitor is coupled via the DC-DC converter to the at least one electronic component in order to apply thereover a stable direct voltage.

8. The hearing aid as claimed in claim 5, wherein the ultra-capacitor is coupled to an inductive coupling element configured to operationally intercept and receive an externally applied electromagnetic induction field as charging current therefrom.

9. The hearing aid as claimed in claim 1, wherein the electrical cable connection comprises, on at least one end, a connector for a releasable connection to at least one of the device housing and the completely-in-canal (CIC) component of the device.

10. The hearing aid as claimed in claim 1, wherein the device housing comprises at least one further microphone.

11. The hearing aid as claimed in claim 1, wherein the device housing comprises an exchangeable outer shell.

12. The hearing aid as claimed in claim 1, further comprising:

a portable external expansion unit, wherein electronic coupling means are provided between said external expansion unit and said outside-the-ear (BTE) component.

13. The hearing aid as claimed in claim 12, wherein the coupling means comprise means for wireless signal transmission in accordance with a first protocol for wireless communication between the hearing aid and the expansion unit, and wherein the expansion unit comprises with means for wireless signal transmission in accordance with a differing second protocol for wireless communication between the expansion unit and a further device.

14. The hearing aid as claimed in claim 12, wherein a rechargeable power supply is applied in the behind-the-ear (BTE) component, wherein the expansion unit is provided with a further power supply, and wherein the coupling means comprise a power supply connection for power supply from the power supply of the expansion unit to the rechargeable power supply of the behind-the-ear (BTE) component.

15. The hearing aid as claimed in claim 12, wherein the expansion unit comprises at least one further microphone.

16. The hearing aid as claimed in claim 12, wherein the expansion unit comprises coupling means for signal transmission from an external audio source in order to receive an audio signal therefrom, and wherein the expansion unit is configured to transmit the audio signal to the hearing aid.

17. The hearing aid as claimed in claim 12, wherein the expansion unit comprises storage means for electronic data storage.

18. The hearing aid as claimed in claim 12, wherein the expansion unit comprises a standardized communication interface for data exchange with a computer.

19. The hearing aid as claimed in claim 12, wherein the expansion unit is provided with a programming interface configured to exchange data with a corresponding programming interface of the hearing aid for adjusting the processing device.

20. The hearing aid as claimed in claim 12, wherein the expansion unit is connected to a necklace.

21. The hearing aid as claimed in claim 12, wherein the expansion unit is configured to co-act with an electronic host device.

22. The hearing aid as claimed in claim 21, wherein the expansion unit is at least partially accommodated in a standardized add-on body manually releasable from the host device.

23. The hearing aid as claimed in claim 5, wherein the ultra-capacitor having has in the fully charged state an energy-weight ratio of between about 1.0 and 10 Wh/kg.

24. The hearing aid as claimed in claim 6, wherein the plurality of elongate dielectric tubes are carbon elongate dielectric tubes.

25. The hearing aid as claimed in claim 12, wherein the portable external expansion unit is processor-controlled.

26. The hearing aid as claimed in claim 17, wherein the storage means for electronic data storage is an electronically rewritable and readable semiconductor memory.

27. The hearing aid as claimed in claim 26, wherein the storage means for electronic data storage is a Flash EEPROM.

28. The hearing aid as claimed in claim 18, wherein the standard communication interface is one of USB (Universal Serial Bus) or IEEE 1394 (FireWire).

29. The hearing aid as claimed in claim 22, wherein the standardized add-on body is one of the group consisting of an SDIO (Secure Digital Input Output) card, a Smart Card, an MM (Multi Media) card, a PCMCIA (Personal Computer Memory Card International Association) card, an Express card, and a CardBus card.

* * * * *